US009501084B1

(12) United States Patent
Bannister

(10) Patent No.: US 9,501,084 B1
(45) Date of Patent: Nov. 22, 2016

(54) WEARABLE ELECTRONIC DEVICE WITH FORCE FEEDBACK

(71) Applicant: SD Technologies, LLC, Washington, PA (US)

(72) Inventor: Jason Adam Bannister, Pittsburgh, PA (US)

(73) Assignee: SD Technologies, LLC, Washington, PA (US)

( * ) Notice: Subject to any disclaimer, the term of this patent is extended or adjusted under 35 U.S.C. 154(b) by 0 days.

(21) Appl. No.: 14/511,670

(22) Filed: Oct. 10, 2014

Related U.S. Application Data

(60) Provisional application No. 61/889,145, filed on Oct. 10, 2013.

(51) Int. Cl.
*G05G 9/047* (2006.01)

(52) U.S. Cl.
CPC .... *G05G 9/047* (2013.01); *G05G 2009/04766* (2013.01)

(58) Field of Classification Search
None
See application file for complete search history.

(56) References Cited

U.S. PATENT DOCUMENTS 4,142,180 A * 2/1979 Burson ..... A63F 13/06 345/161
4,148,014 A * 4/1979 Burson ..... G05G 9/047 273/148 B
4,161,726 A * 7/1979 Burson ..... G05G 9/047 200/6 A
5,558,329 A * 9/1996 Liu ..... A63F 13/06 273/148 B
6,002,351 A * 12/1999 Takeda ..... G05G 9/047 200/6 A
H1831 H * 2/2000 Kelley ..... B60N 2/4633 180/333
6,429,849 B1 * 8/2002 An ..... G05G 9/047 345/161
6,573,885 B1 * 6/2003 McVicar ..... F16D 3/382 345/156
6,664,666 B2 * 12/2003 Corcoran ..... G05G 9/047 310/12.23
2008/0272243 A1 * 11/2008 Decker ..... B64C 13/04 244/221
2009/0146018 A1 * 6/2009 Konig ..... G05G 9/047 244/221
2010/0011903 A1 * 1/2010 Koschke ..... B62D 1/12 74/524

* cited by examiner

*Primary Examiner* — David D Davis
(74) *Attorney, Agent, or Firm* — Fox Rothschild LLP

(57) ABSTRACT

A wearable electronic device provides force feedback that acts on a controller of the device. At least one actuator coupled to the controller receives inputs from a host computing system and applies forces in at least one of two allowed degrees-of-freedom to the movable controller. The actuator includes an axle that is rotatably driven by an electric motor, and a force transmission gear assembly for transmitting the torque from the motor to the controller via the axle.

15 Claims, 5 Drawing Sheets

WEARABLE ELECTRONIC DEVICE WITH FORCE FEEDBACK

CROSS-REFERENCE TO RELATED APPLICATIONS

This patent document claims priority to U.S. Provisional Application No. 61/889,145, filed Oct. 10, 2013. The disclosure of the priority application is fully incorporated by reference.

BACKGROUND

This document relates generally to wearable electronic devices that provide improved force feedback to the user.

Current, popular gaming devices include game consoles that include a host computing device that is connected to a home television set or other electronic display. Users of these devices typically interact with a game or other application program using an interface device connected to the host computer (e.g. game console). Such interface devices may include joysticks, gamepads, steering wheels, or other game controller devices. A user moves a user manipulatable object, such as a joystick, wheel, mouse, button, dial, or other object, which is sensed by the host computer and used to manipulate a graphical environment displayed by the host computer. Recently, force feedback in interface devices has become available as well, where the host computer and/or a microprocessor control an actuator apparatus to output forces to the user. These forces are correlated with events or objects in the graphical environment to further immerse the user in the gaming experience or interface task.

One important concern in the prior art force feedback devices is the issue of user safety. A force feedback device can impart physical forces upon the user, and therefore the potential for injury must be carefully addressed. Additionally, traditional force feedback gaming controllers typically are not able to address a broad range of haptic user experiences intended to represent real world tactile experiences.

This document describes devices that are intended to address the issues discussed above and/or other issues.

SUMMARY

This disclosure is not limited to the particular systems, devices and methods described, as these may vary. It is also to be understood that the terminology used herein is for the purpose of describing particular embodiments only, and is not intended to limit the scope.

In an embodiment, an electronic device for transmitting feedback forces to a user may include a joystick having at least two degrees of freedom of movement and a first actuator configured to impart forces on the joystick in response to a first signal. The first actuator may include a first brushless motor for generating a first torque, a first transmission, and a first axle. The first transmission may include a first gear and a first gear segment that are interconnected, and a first limit structure that limits a range of rotation of the first gear and the first gear segment, where the first gear is connected to a rotor of the first brushless motor. The first axle may connect the first transmission to the joystick so that the first torque is transmitted from the second gear segment to the joystick and move the joystick along at least one of its degrees of freedom via the first axle when the first motor is operated.

In an embodiment, a wearable electronic device for transmitting feedback forces to a user may include a joystick having at least two degrees of freedom of movement, a power source, and a first actuator configured to impart inertial forces on the joystick in response to a first signal. The first actuator may include a first brushless motor for generating a first torque, a first transmission for transmitting the first torque from the first motor, and a first hollow axle. The first hollow axle may connect the first transmission to the joystick, so that the first torque is transmitted from the first transmission to the joystick and move the joystick along at least one of its degrees of freedom via the first axle when the first motor is operated. The first actuator may also include a first power wire that electrically connects the first brushless motor to the power source via a central cavity of the first hollow axle.

DETAILED DESCRIPTION

Figure 1A:
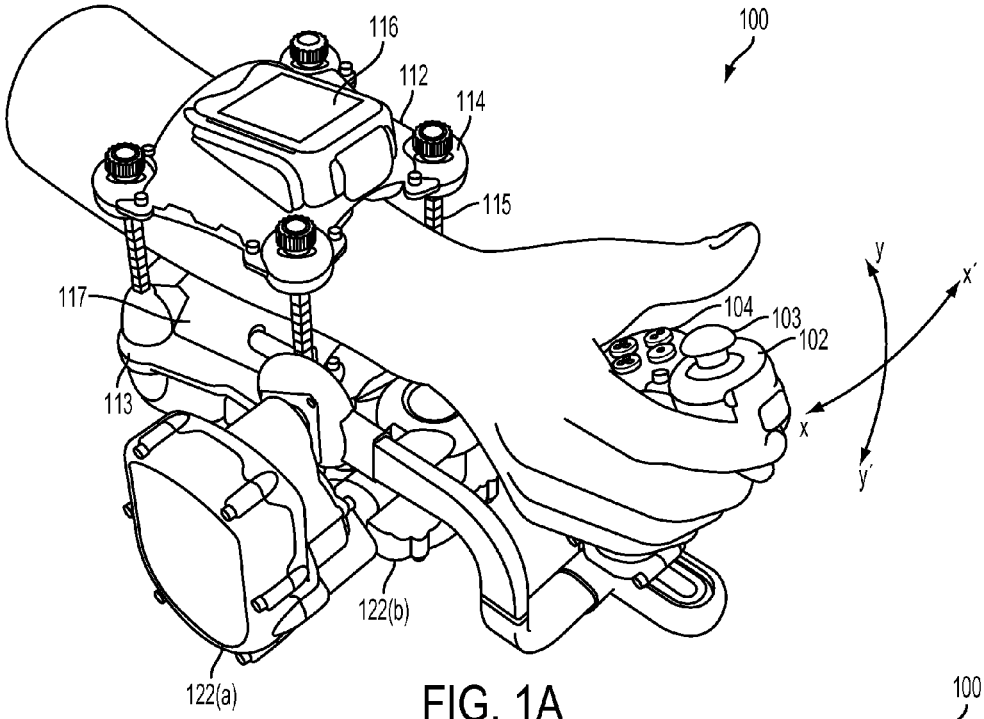
FIGS. 1A-1D illustrate various schematic views of an embodiment of the wearable electronic device of the present disclosure depicting the externally visible components, housing, and a joystick being held by a user.
Figure 1B:
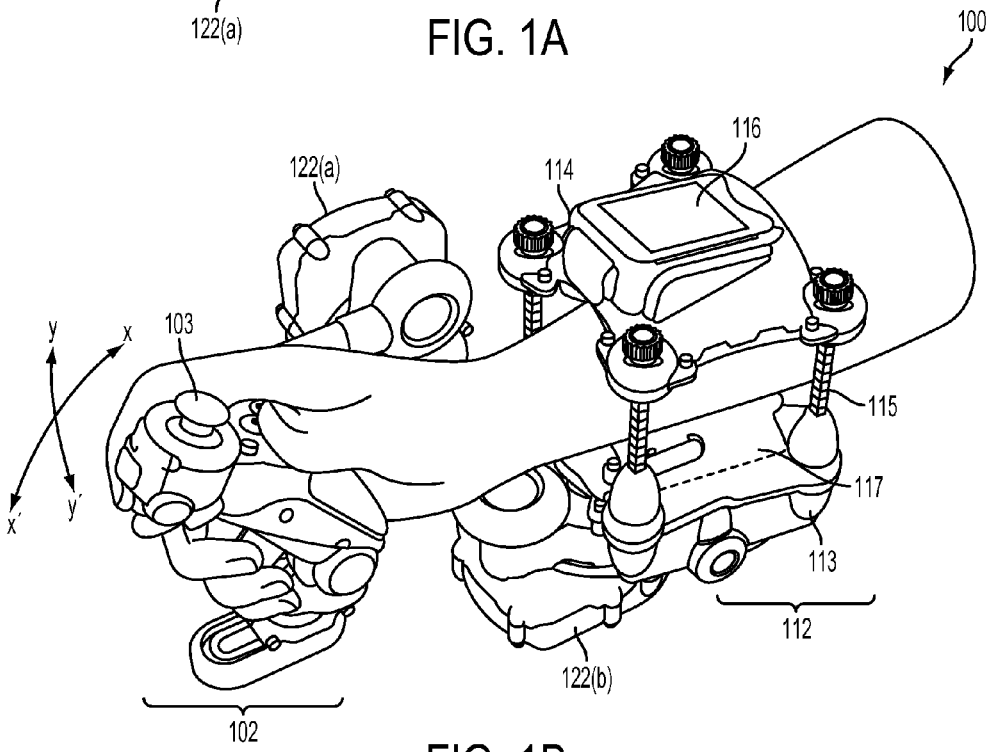
Figure 1C:
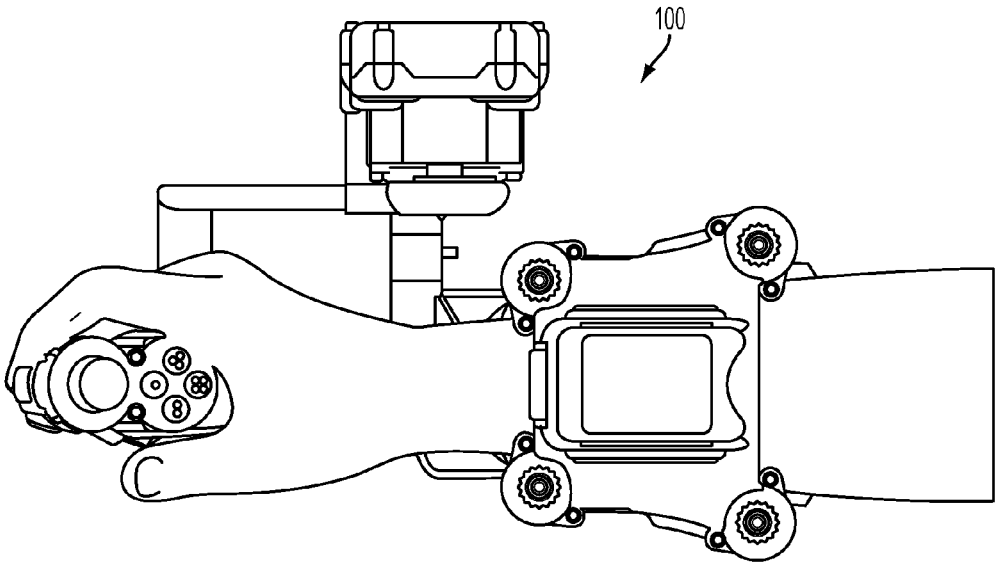
Figure 1D:
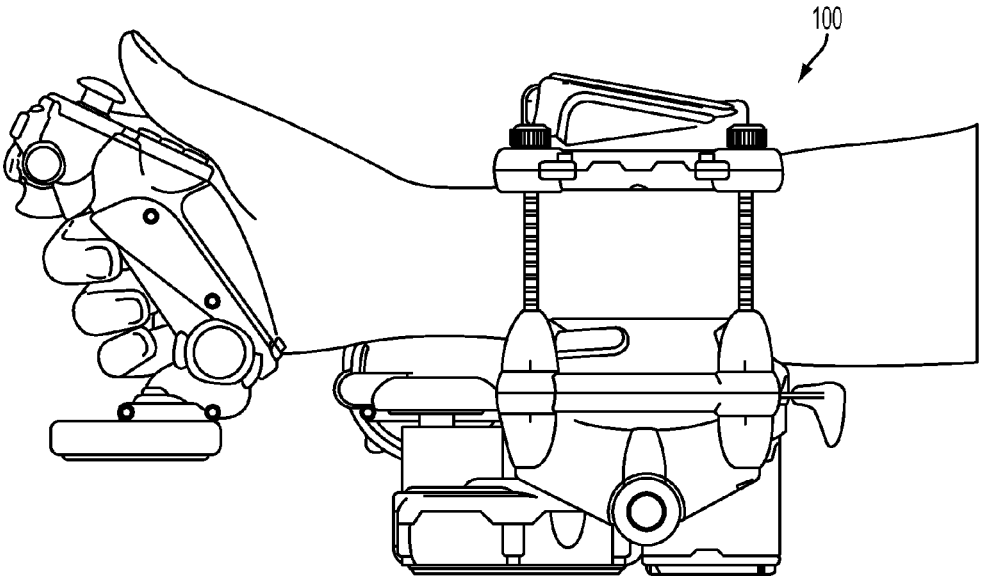

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to."

In this document, the term "force feedback" is intended to include both tactile (or vibrotactile) feedback (forces transmitted to user skin surfaces) and kinesthetic feedback (forces provided in degree(s) of freedom of motion).

The term "wearable electronic device" is intended to refer to any electronic controller or interface device that outputs inertial forces, such as pulses or vibrations, to the user of the device. Such devices may include game controllers such as gamepads, handheld steering wheels, fishing-type controllers, joysticks, mice, trackballs, grips, remote controls. Such devices also may include medically therapeutic devices such as rehabilitation devices that may be used in physical therapy applications.

FIGS. 1A-1D are schematic views of an example embodiment of a wearable electronic device 100 in accordance with the principles of the present disclosure. Device 100 enables a user to provide input signals to a host computing system (not shown here), and is adapted to enable a user to perceive a tactile sensation as a result of force feedback signals received from the host computing system. The host computing system may be integral with device 100, or it may be a separate that is in electronic communication with device 100. Device 100 generally includes a controller 102 for providing user input, which is shaped generally for an easy grasp by the user as shown in FIGS. 1A-1D. User manipulatable components are mounted on controller 102 to facilitate user control of graphic objects on host computing system. User manipulatable components of the controller 102 may include a movable thumb stick 103 for speed user input, one or more buttons 104 for button user input, and at least two degrees of freedom of movement with respect to the ground for providing directional user input. Controller 102 also includes one or more actuators integrated with the controller, as explained below with reference to FIG. 3. In operation, the user grasps or otherwise touches controller 102 while operating the controller to feel force feedback signals. In some embodiments, such as the ones shown in FIGS. 1A-1D, the controller is one or more joysticks that may be moved by a user in two rotary or linear degrees of freedom to provide control input to the host computing system. In certain other embodiments, the controller 102 can also be a touch sensitive direction pad having four or more directions which can provide input to the host computer, a rotary dial, a linear slider, a wheel, a finger receptacle, a cylinder, or other controlling member. In other embodiments, controller 102 may be a motion-type controller that transmits signals with information about the user's real-world movements in three-dimensional space to a motion sensing receiver. It will be understood to those skilled in the art that controllers for use with console gaming systems, such as those available from Sony, Nintendo, Microsoft, or Sega, can be modified for use with the present disclosure.

Device 100 also includes sensors (not shown here) to sense the position or motion of the controller 102 and provide signals to a microprocessor or the host computing system (discussed below) including information representative of the position or motion. Sensors suitable for detecting motion of a joystick or other controllers include digital optical encoders frictionally coupled to a rotating ball or cylinder, as is well known to those skilled in the art. Mechanical switches, linear optical encoders, potentiometers, optical sensors, velocity sensors, acceleration sensors, strain gauges, or other types of sensors can also be used, and either relative or absolute sensors can be provided to yield information about correct position of the controller 102. An optional sensor interface can be used to convert sensor signals to signals that can be interpreted by a microprocessor or host computing system. In addition, a position sensor, such as a potentiometer, may detect the position of a connected actuator's motor to indirectly determine the position of the controller 102. A sensor signal from the position sensor is relayed to the microprocessor or host computing system enabling it to indirectly determine position, velocity, and an acceleration of the controller. An optional acceleration sensor may detect the controller's acceleration which may be defined as an inertial coordinate in flat space-time (without gravity). Signals from the position and/or acceleration enables the device to relay pitch, yaw or roll movements to the microprocessor or host computing system by simply tilting the controller 102, as is well known to those skilled in the art.

Figure 4:
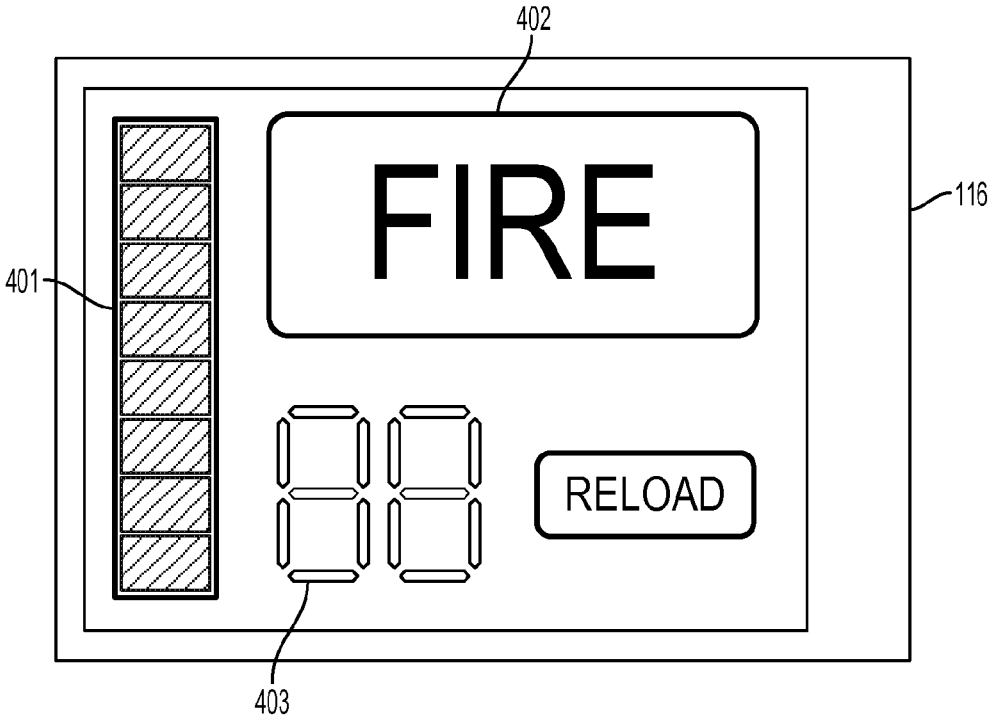
FIG. 4 is a top view of an LCD display screen to be used in accordance with the principles of the current disclosure.

Device 100 may further include a wearable housing 112 shaped generally to receive the arm of a user as shown in FIGS. 1A-1D. As shown, housing 112 includes a bottom 113 and a top 114 held together by four fasteners 115, such as threaded fasteners. The height of the fasteners 115 is adjustable, such that the top 114 can be moved up and down with respect to the bottom 113 (or vice versa) to allow for secure fastening of the user's arm within the housing. The housing can further include a display screen 116 mounted on the top 114, and coupled to a printed circuit board (PCB) 117 disposed within the bottom 113 portion of the housing. Other housing structures may be used. For example, wearable housing 112 may be in the form of a wearable cuff, a clam shell structure, or other structure. Instead of fasteners, the housing portions may be secured together by hinges, straps, hook-and-loop, bands, clips, or other connecting structures. In an embodiment, the display screen 116 is a 2.4" LCD display screen. However, it will be understood that other display screens known in the art maybe used. The display screen 116 is generally configured to provide real time feedback to the user. The real time feedback may include, for example, information regarding health, time elapsed, expended energy, or other parameters, of a virtual player in the form of a status bar 401, a score or other measurement 403, instructions 402, and a radar display as shown in FIG. 4. The display screen 116 may receive this information from a microprocessor that is in communication with the PSB 117. The display screen 116 may also be configured to send information back to the host computing system. The display screen 116 may be configured to receive information from the user using touch inputs, and it may be connected to a microprocessor within the PCB 117 for transmitting the received information to the host computing system as discussed below.

Returning to FIGS. 1A-1D, device 100 further comprises a PCB 117, including circuitry for providing power management and control of motor 30. PCB 117 may be included within the wearable housing 112 of device 100 to allow efficient communication with other components of the device 100. PCB 117 is considered local to device 100, where "local" herein refers to PCB 117 being separate from any processors in the host computing system. "Local" also refers to PCB 117 being dedicated to control the force feedback and sensor input/output of device 100.

PCB 117 may include a communications device and antenna, such as a near-field or short range communication device. As an example, a Bluetooth chip may act as an interface for sending and receiving input/output signals to the host computing system. It will be understood that other signaling interfaces can be used such as a USB communications interface.

PCB 117 further includes at least one microprocessor. The microprocessor is provided with software instructions to wait for commands or requests from the host computing system, decode or parse the command or request, and handle/control input and output signals according to the command or request. The instructions may be stored in a connected memory or programmed via software or firmware included on the PCB 117, such as field programmable gate array. In some embodiments, the processor can operate independently of host computing system by receiving sensor signals and calculating appropriate forces from those sensor signals, time signals, and stored or relayed instructions selected in accordance with a host command. The microprocessor may include one microprocessor chip, multiple processors and/or co-processor chips, and/or digital signal processor (DSP) capability. Microprocessor may further include encoder processing circuitry, communication circuitry, and Pulse Width Modulated (PWM) circuitry. Microprocessor receives signals from sensors and provides control signals to actuators 122*a* and 122*b* in accordance with internal instructions and/or instructions provided by host computing system via control wiring. In one embodiment, the control signal is a PWM signal generated by the microprocessor and sent to the actuators to control the power supplied to the actuators.

In one embodiment, the host computing system provides supervisory commands to the microprocessor, and the microprocessor decodes the commands and manages force control loops to the sensors and the actuator in accordance with the commands but independently of the host computer.

In an embodiment, a force control loop is operable between the microprocessor and the host computing system, wherein force commands are output from the host computing system to the microprocessor, and instructs the microprocessor to output a force or force sensation having specified characteristics. The local microprocessor in turn reports data to the host computer, such as locative data that describes the position of the controller 102 in one or more provided degrees of freedom. The data may also describe the states of buttons or other devices of device 100. The host computer may use the data in the execution of one or more programs and/or it may store the data for future use and retrieval. Additionally, a local control loop may be operable between the microprocessor and the actuators wherein, actuator signals are provided from the microprocessor to the actuators and sensor signals are provided from the sensors and other input devices to the microprocessor. The microprocessor processes inputted sensor signals to determine appropriate output actuator control signals by following stored instructions, or instructions received in real time. The microprocessor uses sensor signals in the local determination of forces to be output, as well as for reporting locative data derived from the sensor signals to the host computing system. The microprocessor may also energize the actuator based upon user input signals from the controller 102. In certain embodiments, other hardware, well known in the art, can be provided locally to device 100 to provide functionality similar to the microprocessor.

The microprocessor may be coupled to a programming chip within the PCB 117 to configure the microprocessor to perform the functions described above. The programming chip may also allow the user to alter the executable code it implements in response to commands received from the host computing system. This flexibility opens up the opportunity to customize the operation of the PCB 117 for specific host applications.

In yet another embodiment, host computing system can provide force commands which are directly transmitted to the actuator via microprocessor or other circuitry (if no microprocessor is present). Host computing system thus may directly control and process all signals to and from the device 100, e.g. the host computing system may directly control the forces output by actuators 122*a* and 122*b*, and directly receive sensor signals from the sensor and input devices.

In an embodiment, the signal from the host to the device 100 indicates whether to pulse the actuator at a predefined frequency and magnitude. In certain other embodiments, the signal from the host may include a magnitude, giving the strength of the desired pulse, and/or a frequency. A local processor may also be used to receive a simple command from the host that indicates a desired force value to apply over time, so that the microprocessor outputs the force value for the specified time period based on the command.

PCB 117 may also include local memory, such as RAM and/or ROM, coupled to the microprocessor to store instructions for the microprocessor and store temporary and other data. Additionally, an external memory jack may be provided in the PCB 117, such as a memory card and/or a micro SD to add to the local memory storage. In addition, a local clock can be coupled to the microprocessor to provide timing data, which might be required, for example, to compute forces output by actuator. In embodiments using the USB communication interface, timing data for microprocessor can be alternatively retrieved from the USB signal.

In an embodiment, PCB 117 further includes one or more light emitting diodes (LEDs) for aesthetic or signaling purposes.

The device 100 as shown in FIGS. 1A-1D also includes actuators 122*a* and 122*b* to transmit inertial forces to the user of the device 100 in response to signals or commands received from the microprocessor and/or host computing system. Alternate embodiments can employ a single actuator, or two or more actuators of the same or differing sizes for providing inertial sensations or forces to the user of the device 100.

Figure 2:
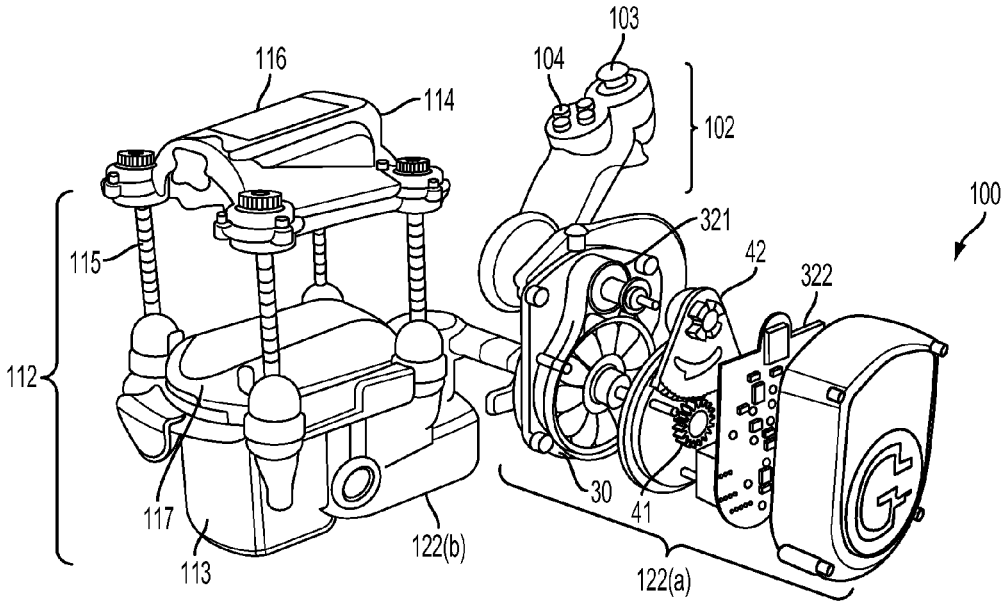
FIG. 2 illustrates a perspective view of an embodiment of the wearable electronic device of the present disclosure depicting an exploded actuator.
Figure 3A:
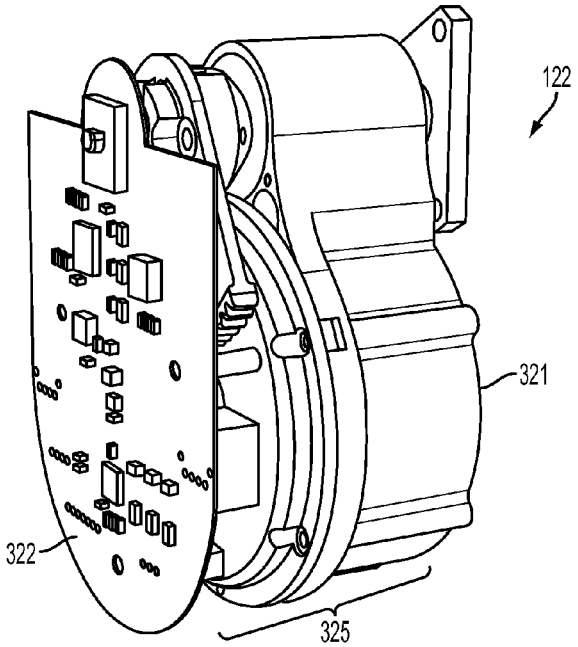
FIG. 3A is a perspective view of an actuator in accordance with the principles of the current disclosure.
Figure 3B:
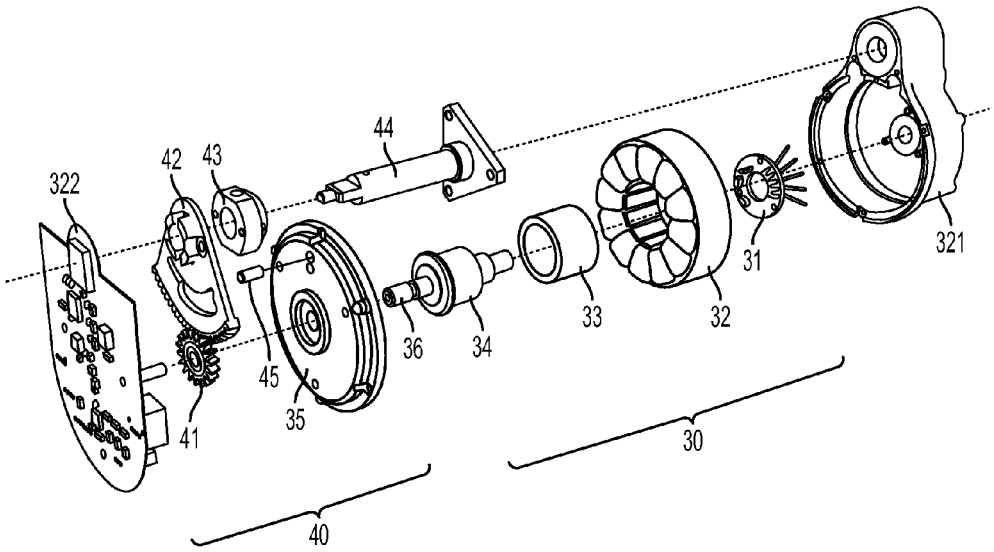
FIG. 3B is an exploded view of the actuator of FIG. 3A.

Referring now to FIGS. 2, 3A and 3B, each actuator 122 includes a motor and gear assembly 325, seated in a contour of a motor housing 321. In an embodiment, motor assembly 325 includes a brushless DC motor 30 powered by a DC electric source. The motor 30 may further include a Hall Effect sensor 31, a stator 32, and a rotor 34 with connected shaft 36. The stator 32 is an armature having multiple coils positioned in a ring as shown in FIG. 3B. In an embodiment, the stator 32 includes 12 copper coils. Additionally, a hollow cylindrical permanent magnet 33 may be disposed on the outside of rotor 34, and positioned within the center of the armature. The cylindrical magnet 33 may be made of neodymium alloy, allowing for the use of a single permanent magnet with differing polarizations. Examples of such magnets are available from vendors such as Applimotion. The motor 30 may include a face plate 35 configured to hold the stator coils in place. In operation, motor 30 may produce a torque on motor shaft 36 of approximately and thus turn the shaft. Optionally, the motor 30 may also include brakes which allow the rotation of the motor shaft 36 to be halted in a short span of time. Other types and models of electric motors can alternatively be used.

In an embodiment, motor housing 321 is configured to function as a heat sink to draw heat away from the brushless DC motor. In some embodiments, the motor housing 321 include one or more fins to increase its surface area, and thus provide more heat dissipating ability.

Affixed to the inwardly extending end of motor shaft 36 is a gear assembly 40. The gear assembly comprises a drive gear 41 coupled to the motor shaft 36. Drive gear 41 engages a partial gear or a sectional gear 42, which has a rotational axis that is parallel to the rotational axis of drive gear 41. As shown in FIG. 3B, the partial gear 42 only has teeth sufficient to accommodate a rotation of up to about 90 degrees about the axis formed by the axle 44. Other limited ranges of rotation are possible, such as up to about 70 degrees or up to about 100 degrees. One possible gear conversion ratio is 3.2:1, but other ratios are possible. Depending on the requirements of a particular application and desired freedoms of rotation, other force transmission gear assemblies can alternatively be used. Partial gear 42 is mechanically coupled to an axle 44, through a hub 43, extending outwardly towards the motor housing 321. Axle 44 is therefore coupled to the partial gear 42 at one end and passes through an opening in the motor housing 321 on the other end.

In an embodiment, the gear assembly 40 further comprises one or more limit pins 45. Limit pin 45 is designed to engage an opening in the face plate 35 of the gear assembly 30 at one end, and a channel in the partial gear 42 at the other end, such that the rotational movement of the partial gear 42 is limited to a desired angle. The limited rotational angle is generally determined by the position of the opening in the face plate 35 and the length of the channel in the partial gear 42. This limited gear rotation angle allows for better safety of the user by limiting the arc range of the force feedback motion imparted to the user. In an embodiment, the rotational angle is limited to a maximum of about 90 degrees by positioning the pin in opening $H_a$ in the face plate 35, and engaging channel $C_a$ in the partial gear 42. In yet another embodiment, the rotational angle is limited to a maximum of about 70 degrees by positioning the pin in opening $H_b$ in the face plate 35, and engaging channel $C_b$ in the partial gear 42.

In an embodiment, axle 44 is hollow including an internal cavity. This flexibility opens up the possibility of passing desired wiring through the hollow axle, such as power and/or control wiring. In an embodiment, the hub 43 may be designed such that it couples the hollow axle 44 to the partial gear 42, while allowing the wiring to pass through the hollow axle 44. The axle 44 may include an opening or openings through which the wiring may drop to its associated components. Because rotation of the axle 44 is limited by the limited rotation of the partial gear 42, the wiring will not wrap around the axle 44.

In an embodiment that includes multiple actuators (such as that shown in FIGS. 1A-1D), the power wiring (not shown here) may electrically connect a power source to a motor within the first actuator assembly 122*a*, and the motor within the first actuator assembly 122*a* to a motor in the second actuator assembly 122*b*. Additionally, the control wiring (not shown here) may connect the microprocessor disposed within PCB 117 to a first control circuitry within the first actuator assembly 122*a*, and the first control circuitry within the first actuator assembly 122*a* to a second control circuitry within the second actuator assembly 122*b*. In an embodiment, the power and/or control wiring pass through the internal cavity of hollow axle 44 of first actuator assembly 122*a*.

The actuator assembly 122 may also include a PCB 322 having first control circuitry, and mounted to the face plate 35. PCB 322 may control the delivery of power and/or control signals to the motor assembly 30. PCB 322 may include an encoder for engaging one end of axle 44, which is coupled to the partial gear 42. The encoder, for example, may also respond to the axle's rotation by producing two phase-related signals in the rotary degree of freedom for transmission to the microprocessor in PCB 117 and/or the host computing system.

In an embodiment, in response to signals received from the microprocessor disposed in PCB 117 and/or host computing system, motor assembly 30 drives the gear assembly 40, which in turn rotates the axle passing through the encoder disposed in PCB 124. The encoder transmits sensory signals to the microprocessor disposed in PCB 117 and/or the host computing system. Rotation of the axle causes the controller 102 to move along one or more degrees of freedom. In an embodiment, an actuator is provided for each degree of freedom along which forces are desired to be transmitted.

A power supply, such as a battery pack, for driving the motor can optionally be included in device 100, or can be provided as a separate component, for example, connected to an electric power cord. Alternatively, if the USB communications interface or other similar communication interface is used in an embodiment, power may be drawn over the interface obviating the need for a separate power supply.

In certain embodiments, an eccentric mass may be coupled to the rotating shaft of the motor. When rotated, the inertial forces from the rotating mass cause an oscillation or vibration in the housing 112 or the controller 102 coupled to the motor housing, thus producing tactile sensations to the user who is holding or otherwise contacting the device 100.

A safety switch may be included in device 100 to provide a mechanism to allow a user to override and deactivate actuators, or require a user to activate actuators, for safety reasons. For example, if a failure in the microprocessor occurs, the user may desire to quickly deactivate the actuators to avoid any injury. To provide this option, safety switch is coupled to the actuators. If, at any time, the safety switch is deactivated (opened), power from power supply is cut to actuators (or the actuators are otherwise deactivated) as long as the safety switch is open.

Host computing system may be any of a variety of computing or electronic devices. In one embodiment, with an external system, the host computing system is a personal computer, game console, or workstation. In other embodiments, host computing system can be a "set top box" which can be used, for example, to provide interactive television functions to users, or a "network-" or "internet-computer" which allows users to interact with a local or global network using standard connections and protocols such as used for the Internet and World Wide Web. Some embodiments may provide a host computing system within the same casing or housing as the interface device or manipulandum that is held or contacted by the user, e.g. handheld video game units, portable computers, arcade game machines, etc.

The above-disclosed features and functions, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

The invention claimed is:

1. An electronic device for transmitting feedback forces to a user, comprising:

a joystick having at least two degrees of freedom of movement;

a first actuator configured to impart forces on the joystick in response to a first signal, wherein the first actuator comprises:

a first brushless motor for generating a first torque, a first transmission comprising a first gear and a first gear segment that are interconnected, and a first limit structure that limits a range of rotation of the first gear and the first gear segment, wherein the first gear is connected to a rotor of the first brushless motor, and a first axle connecting the first transmission to the joystick, so that the first torque is transmitted from the second gear segment to the joystick and move the joystick along at least one of its degrees of freedom via the first axle when the first motor is operated;

a housing configured to receive an arm of a user; and a second actuator configured to impart inertial forces on the housing in response to a second signal, wherein the second actuator comprises:

a second brushless motor for generating a second torque, a second transmission comprising a second gear and a second gear segment that are interconnected, and a second limit structure that limits a range of rotation of the first gear segment and the second gear segment, wherein the second gear is connected to a rotor of the second brushless motor, and a second axle connecting the second actuator transmission to the housing, so that the second torque is transmitted from the second gear segment to the housing via the second axle when the second motor is operated.

2. The device of claim 1, wherein:

the first torque is operative to impart a side to side motion, up and down motion, or a pitch to the joystick; and the second torque is operative to impart a up and down motion, or a pitch to the housing.

3. The device of claim 1, wherein the range of rotation of each of the transmissions is limited to a maximum of about 90 degrees or less.

4. The device of claim 1, wherein the second limit structure comprises a pin that is positioned to stop the second gear segment from rotating beyond the limited range of rotation.

5. The device of claim 1, wherein the housing further comprises:

a host computing device configured to detect user-actuated motion of the joystick and generate the first and second signals; and a power supply.

6. The device of claim 5, further comprising:

power wiring that electrically connects the power supply to the second brushless motor, and first brushless motor to the first brushless motor;

first control circuitry in the first actuator;

second control circuitry in the second actuator; and control wiring that electrically connects the host computing device to the second control circuitry, and the second control circuitry to the first control circuitry.

7. The device of claim 1, wherein:

the first brushless motor comprises:

an armature comprising a plurality of coils positioned in a ring, a cylinder magnet positioned within a center of the ring, wherein the cylinder magnet has a hollow central cavity, and a rotor positioned in part within the central cavity of the cylinder magnet; and the first actuator further comprises a heat sink housing that receives at least a portion of the first brushless motor.

8. The device of claim 1, wherein each of the axles comprises:

a central cavity;

an opening to the central cavity;

a power wire positioned in the central cavity and connected to the axle's corresponding motor via the opening; and a control wire positioned in the central cavity.

9. A wearable electronic device for transmitting feedback forces to a user, comprising:

a joystick having at least two degrees of freedom of movement;

a power source;

a first actuator configured to impart inertial forces on the joystick in response to a first signal, wherein the first actuator comprises:

a first brushless motor for generating a first torque, a first transmission for transmitting the first torque from the first motor, a first hollow axle connecting the first transmission to the joystick, so that the first torque is transmitted from the first transmission to the joystick and move the joystick along at least one of its degrees of freedom via the first axle when the first motor is operated, and a first power wire that electrically connects the first brushless motor to the power source via a central cavity of the first hollow axle;

a housing configured to receive an arm of a user; and a second actuator configured to impart inertial forces on the housing in response to a second signal, wherein the second actuator comprises:

a second brushless motor for generating a second torque, a second transmission for transmitting the second torque from the second motor, a second hollow axle connecting the second transmission to the housing, so that the second torque is transmitted from the second transmission to the housing via the second axle when the second motor is operated, and a second power wire that electrically connects the second brushless motor to the power source via an interior of the second hollow axle.

10. The device of claim 9, wherein:

the first torque is operative to impart a side to side motion, up and down motion, or a pitch to the joystick; and the second torque is operative to impart a up and down motion, or a pitch to the housing.

11. The device of claim 9, wherein each of the first transmission and the second transmission comprises:

a gear and a gear segment that are interconnected; and a limit structure that limits a range of rotation of the gear and the gear segment to a maximum of about 90 degrees;

wherein the gear of each transmission is connected to a rotor of its corresponding brushless motor.

12. The device of claim 11, wherein each of the limit structures comprises a pin that is positioned to stop its corresponding gear segment from rotating beyond the limited range of rotation.

13. The device of claim 9, wherein the housing further comprises a host computing device configured to detect user-actuated motion of the joystick and generate the first and second signals.

14. The device of claim 13, further comprising:

first control circuitry in the first actuator;

second control circuitry in the second actuator; and control wiring that electrically connects the host computing device to the second control circuitry, and the second control circuitry to the first control circuitry.

15. The device of claim 14, further comprising a control wires structure that is positioned to:

pass from the host computing device to the second actuator via an interior cavity of the second hollow axle; and pass from the second actuator to the first actuator via the interior cavity of the second hollow axle and an interior cavity of the first hollow axle.

* * * * *